United States Patent [19]

Campbell et al.

[11] 4,165,148

[45] Aug. 21, 1979

[54] COMPRESSIBLE ELECTRICAL CONNECTOR WITH POSITIVE MECHANICAL LOCK

[75] Inventors: Paul K. Campbell; Edward L. Nichols, III, both of Birmingham, Ala.

[73] Assignee: Square D Company, Park Ridge, Ill.

[21] Appl. No.: 925,737

[22] Filed: Jul. 19, 1978

[51] Int. Cl.[2] ..... H01R 5/08

[52] U.S. Cl. ..... 339/276 R; 174/94 R

[58] Field of Search ..... 339/276 R; 174/84 C, 174/94 R

[56] References Cited

U.S. PATENT DOCUMENTS

| | | | |
|---|---|---|---|
| 3,088,993 | 5/1963 | Matthysse et al. | 339/276 R |
| 3,134,844 | 5/1964 | Myers | 174/94 |
| 3,387,080 | 6/1968 | Dibble et al. | 339/276 R |

*Primary Examiner*—Joseph H. McGlynn

*Attorney, Agent, or Firm*—Carmen B. Patti; John R. Garrett

[57] ABSTRACT

This disclosure depicts a ductile metallic electrical and mechanical connector for attachment to one or more electrical cables and formable by a compressible process. The connector comprises at least one bifurcated body member having first and second leg portions initially connected by a reduced cross-sectional thickness portion of the body member to provide a plastically flowable hinge connection. The first and second leg portions define an initial predetermined angle such that the body member can laterally engage an uninsulated section of an electrical cable. The first leg has on the end opposite the reduced thickness portion an axially extending rib member and axially extending inner and outer ridges disposed on either side of the rib member. The second leg has on the end opposite the reduced thickness portion axially extending inner and outer fingers. The rib member, the inner and outer ridges and the inner and outer fingers are oriented such that the outer finger lies between the outer ridge and the rib member and the inner finger lies between the inner ridge and the rib member, when the body member is closed about an uninsulated section of an electrical cable. The enclosure occurs by pivoting of the leg members about the reduced thickness portion in response to hand applied external pressure. The inner and outer fingers and the rib member are deformed to form a positive mechanical lock when an external crimping force is applied radially to the body member.

8 Claims, 14 Drawing Figures

COMPRESSIBLE ELECTRICAL CONNECTOR WITH POSITIVE MECHANICAL LOCK

BACKGROUND OF THE INVENTION AND PRIOR ART STATEMENT

This invention relates in general to metallic electrical and mechanical cable connectors for use in repairing and joining electrical cables, and in particular to a connector which, when deformed about the uninsulated portion of an electrical cable by a radially applied crimping force, forms a positive mechanical lock.

Numerous types of connectors are used for repairing or joining electrical cables. One type is a connector which must be bolted on to the cable. The major drawback with this type of connector however, is that there is a multiple number of parts which must be utilized in assembling the connector and these parts may be dropped or lost. In addition, assembly of this type of connector is a time consuming process.

Another type of commonly used connector has a C shape cross-sectional configuration which is then deformed by compression about the electrical cable. The resulting closure as the two ends of the connector come together result in a "non-overlapping joint". When the cable moves (for example, during installation positioning and/or when the cable is subjected to a wind load) the connector is subjected to various torques. As a result the non-overlapping joint of the connector may initially be loosened by installation positioning movements of the tap wire and also may tend to work loose over a period of time. This is especially true when the connector is used as a tap, that is, when a second cable extends from the main cable for tapping off of the line. This type of connector is disclosed in U.S. Pat. Nos. 3,185,762; 2,956,108; 3,275,738; and 3,032,602.

Another type of connector in use has a "overlapping joint" when the connector is closed about a cable. Although it is believed that the "overlapping joint" type cable is superior to the "non-overlapping joint" type the "overlapping joint" type connector is still subject to opening up under various torques and loads which may be applied to the cable during installation and under heavy wind loads. Typical patents disclosing this type of cable are U.S. Pat. Nos. 3,156,764; 3,781,459; 3,236,938; and 3,322,888.

Some connectors employ various types of locking mechanisms such that when the connector is closed about the cable the connector will stay shut and, thereafter, when it is crimped it will form a locking type joint which will resist opening under various torques and loads which may be applied to the cable. These connectors which are believed to be superior to the "non-overlapping joint" types and "overlap joint" types. However, this type locking joint is limited to conventional dies which envelops a significant portion of the connector mass in order to mate the locking members during compression without substantially altering the shape of the locking members. Locking connectors of these designs do not lock when crimped with a four nib, indention compression known as "VERSA-CRIMP" ®. U.S. Pat. No. 3,134,844 discloses a connector having a locking type mechanism. When the connector is crimped by an externally applied force, the metal tightens the lock but does not substantially alter the shape of the lock sections. Connectors of these type are disclosed in U.S. Pat. Nos. 3,134,844; 3,522,365; and 3,387,080.

Another type of connector is known that has a sliding keeper which is inserted longitudinally in grooves in the main body of the connector. After the connector is so assembled about the cable the connector is crimped by an externally applied force. This connector has several disadvantages one of which is that it has at least two separate pieces, one of which may be dropped or lost during the assembly. Also the keeper may be difficult to insert if the connector or the keeper has been slightly deformed.

It is important to note that the present invention employs the use of an externally applied crimping force which result in what is known as a "VERSA-CRIMP" connection. This type of crimping force is disclosed in U.S. Pat. No. 3,006,983 issued to W. R. McDurmont.

The relevance of the prior art indicated in the present application should not be given a limited interpretation. A cited prior art item may be found to have relevance in a passage other than the one referred to or to have relevance in a sense different than as stated.

OBJECTS OF THE INVENTION

It is a general object of the present invention to provide a metallic electrical and mechanical connector for attachment to one or more electrical cables.

It is an another object of the present invention to provide a connector which is easy and quick to install.

It is a further object of the present invention to provide a connector which resists opening when the cable is subjected to various torques and loads.

It is a further object of the present invention to provide a wide conductor range connector which resists opening when the cable is subjected to various torques and loads, and which can be compressed with the "VERSA-CRIMP" compressible process as disclosed in U.S. Pat. No. 3,006,983.

BRIEF DESCRIPTION OF THE DRAWINGS

The features of the present invention which are believed to be novel are set forth with the particularity in the appended claims. The invention together with further objects and advantages may best be understood by reference to the following description taken in conjunction with the accompanying drawings, in the several figures of which like reference numerals identify like elements, and in which:

DESCRIPTION OF THE PREFERRED EMBODIMENT

This invention relates to a metallic electrical and mechanical connector for attachment to one or more electrical cables and more specifically a connector which is formable by a compressible process. Whereas the connector may be used with various types of compressible processes it is designed primarily for use with a "VERSA-CRIMP" compressible process as disclosed in U.S. Pat. No. 3,006,983.

The present invention will now be described. The present invention is a novel ductile metallic electrical and mechanical connector for attachment to one or more electrical cables and formable by a compressible process. The connector comprises at least one bifurcated body member having first and second leg portions initially connected by a reduced cross-sectional thickness portion of the body member to provide a plastically flowable hinged connection. The first and second leg portions define an initial predetermined angle such that the body member can laterally engage an uninsulated section of an electrical cable. The first leg has on the end opposite the reduced thickness portion an axially extending rib member and axially extending inner and outer ridges disposed on either side of the rib member. The second leg has on the end opposite the reduced thickness portion axially extending inner and outer fingers. The rib member, the inner and outer ridges and the inner and outer fingers are oriented such that the outer finger lies between the outer ridge and the rib member and the inner finger lies between the inner ridge and the rib member, when the body member is closed about an uninsulated section of the electrical cable. The enclosure occurs by pivoting of the leg members about the reduced thickness portion in response to hand applied external pressure. The inner and outer fingers and the rib member are deformed to form a positive mechanical lock when an external crimping force is applied radially to the body member.

Figure 1:
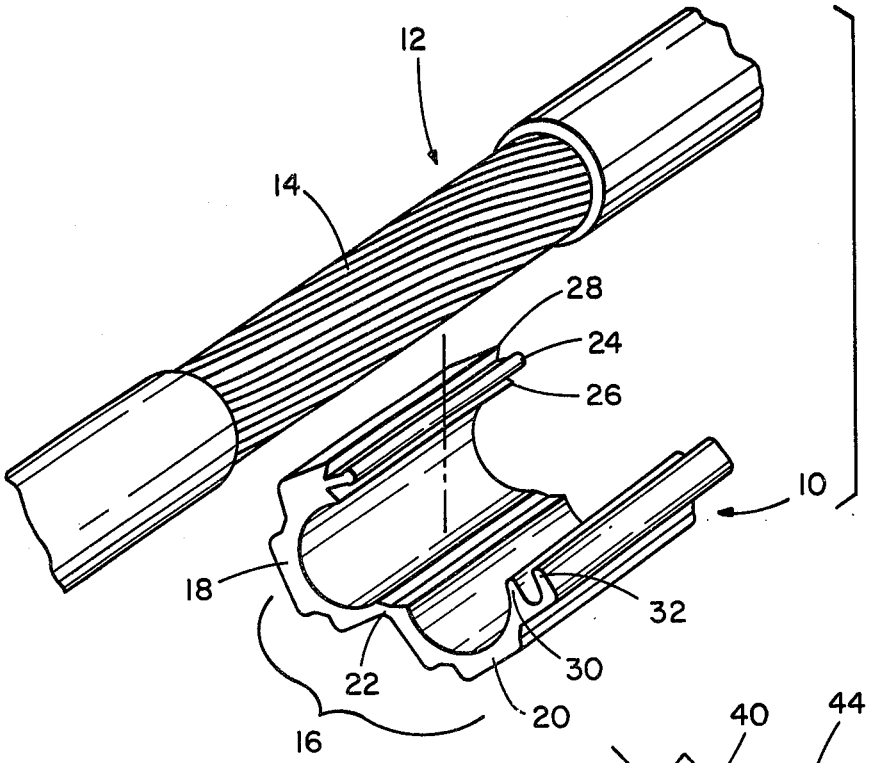
FIG. 1 is a perspective view of a novel electrical and mechanical connector and of an electrical cable.
Figure 2:
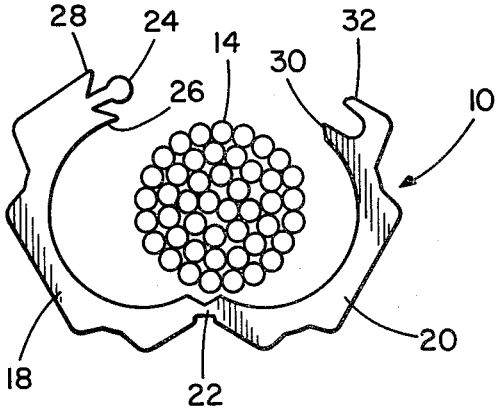
FIG. 2 is an end view of the novel connector located about the cable.

FIGS. 1–4 illustrate a preferred embodiment of the present invention. FIG. 1 shows the ductile metallic electrical and mechanical cable 10 in the open position before being used on the electrical cable 12. The electrical cable 12 has a portion 14 about which the insulation has been removed. In this application the connector may be used, for example, to repair the cable 12 at a point where some of the outer current carrying strands of the cable 12 may have been damaged. Once the connector 10 is applied to the uninsulated portion 14 of the cable 12 the current carrying capability of the cable 12 will be restored. This is only one of many applications which the connector 10 can serve. Other applications of the connector 10 may be, for example, splicing cables which are not under tension. FIG. 2 shows the connector 10 placed in position about the uninuslated portion 14 of the cable 12 and ready to be closed about the portion 14. The connector 10 has a bifurcated body member 16 which has a first leg portion 18 and a second leg portion 20. The first and second leg portions 18 and 20 are initially connected by a reduced cross-sectional thickness portion 22 of the body member 16. This reduced cross-sectional thickness portion 22 provides a plastically flowable hinge connection. The first and second leg portions 18 and 20 define an initial predetermined angle such that the body member 16 can laterally engage the uninsulated portion 14 of the electrical cable 12 as shown in FIG. 2.

The first leg 18 has on the end opposite the reduced thickness portion 22 an axially extending rib member 24 and axially extending inner and outer ridges 26 and 28 disposed on either side of the rib member 24.

Figure 3:
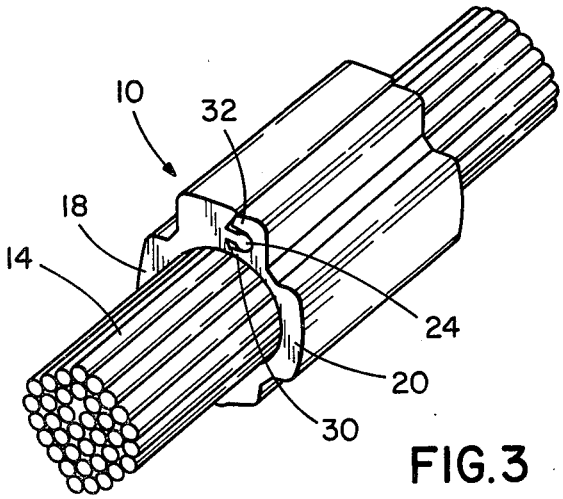
FIG. 3 is a perspective view of the connector closed about the uninsulated portion of the electrical cable.

The second leg 20 has on the end opposite the reduced thickness portion 22 axially extending inner and outer fingers 30 and 32. The rib member 24, the inner and outer ridges 26 and 28 and the inner and outer fingers 30 and 32 are oriented such that the outer finger 32 lies between the outer ridge 28 and the rib member 24 and the inner finger 30 lies between the inner ridge 26 and the rib member 24 when the body member 16 is closed about the uninsulated section 14 of the electrical cable 12. The enclosure occurs by pivoting of the leg members 18 and 20 about the reduced thickness portion 22 in response to hand applied external pressure as shown in FIG. 3.

Figure 4:
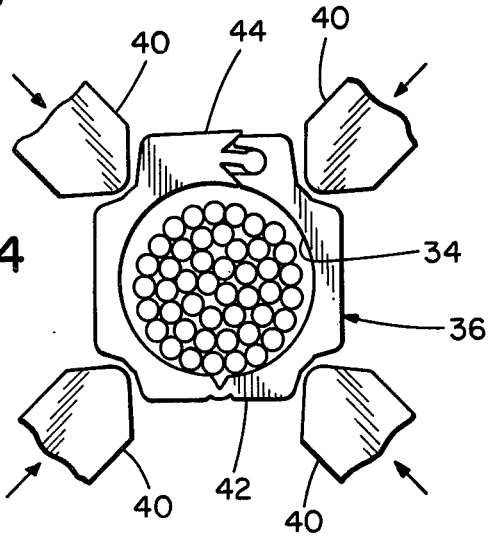
FIG. 4 is an end view of a connector closed about the electrical cable and schematically showing the method of radially crimping the connector about the cable.

After the connector 10 is closed about the cable 12 the connector 10 is subjected to an external crimping force applied radially to the body member 16 as shown in FIG. 4. The body member 16, when in the closed position, has an inner surface 34 of substantially circular cross-sectional configuration and an outer surface 36 having four sides defining a substantially square cross-sectional configuration. The outer surface 36 also is characterized by having four corner indentations 38 for receiving four nibs 40 of a VERSA-CRIMP tool. The four nibs 40, as they are moved inward by the VERSA-CRIMP tool, apply the radially directed crimping force. The reduced cross-sectional thickness portion 22 is located at substantially the center of a first side 42 of the four sides of the outer surface 36. The rib member 24, the inner and outer ridges 26 and 28 and the inner and outer fingers 30 and 32 are located away from the center of a second side 44 of the outer surface 36 and near one of the corner indentations 38 adjacent the second side 42. The second side 44 is opposite the first side 42.

Figure 5A:
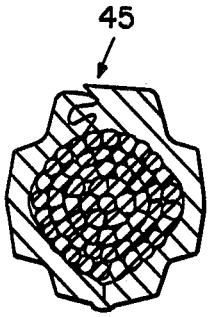
FIGS. 5*a* to 5*c* are cross-sectional views of the connector and a large electrical cable, illustrating the deformation of the connector and cable as the connector is crimped.
Figure 5B:
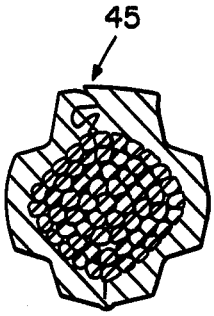
Figure 5C:
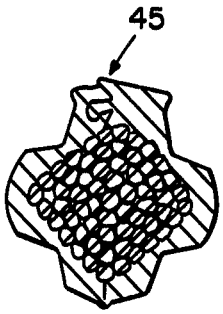

FIGS. 5*a* to 5*c* illustrate the result of applying the VERSA-CRIMP type crimping force to the novel connector 10. These figures depict the result of an actual test on a cable.

Figure 6A:
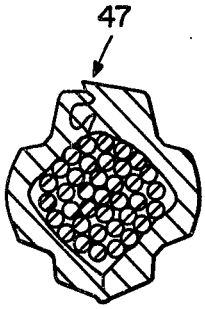
FIGS. 6*a* to 6*c* are cross-sectional views of the connector and a small cable, showing the connector being crimped.
Figure 6B:
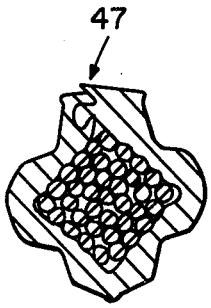
Figure 6C:
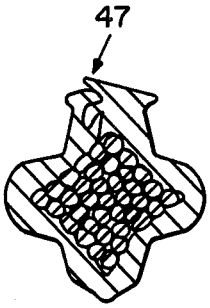

FIGS. 5*a* to 5*c* and FIGS. 6*a* to 6*c* depict the result of an experiment which was conducted. The connector was placed about an electrical cable and crimped using the VERSA-CRIMP procedure. At various points in the crimping process the process was stopped, and the connector and cable were cut cross-sectionally so that the interface of the rib member and inner and outer ridges with the inner and outer fingers could be observed. FIGS. 5*a* to 5*c* depict various stages of the crimping process about a maximum size electrical cable illustrating the changing configuration of interface 45. FIGS. 6*a* to 6*c* depict the crimping process about a minimum size electrical cable and the changing configuration of interface 47. The fully crimped connectors in FIG. 5*c* and 6*c* show the jig-saw puzzle-like interface configuration 45, 47, which form positive mechanical locks. The maximum size cable used was a 750 MCM 61 stranded AAC and the minimum size cable used is a 500 MCM 37 stranded AAC. The following chart indicates the various forces in pounds per square inch that were applied.

| FIGURE | CRIMPED AT |
|---|---|
| 5A | 4000 PSI |
| 5B | 7500 PSI |
| 5C | 10,400 PSI |
| 6A | 4000 PSI |
| 6B | 7500 PSI |
| 6C | 10,400 PSI |

Figure 7:
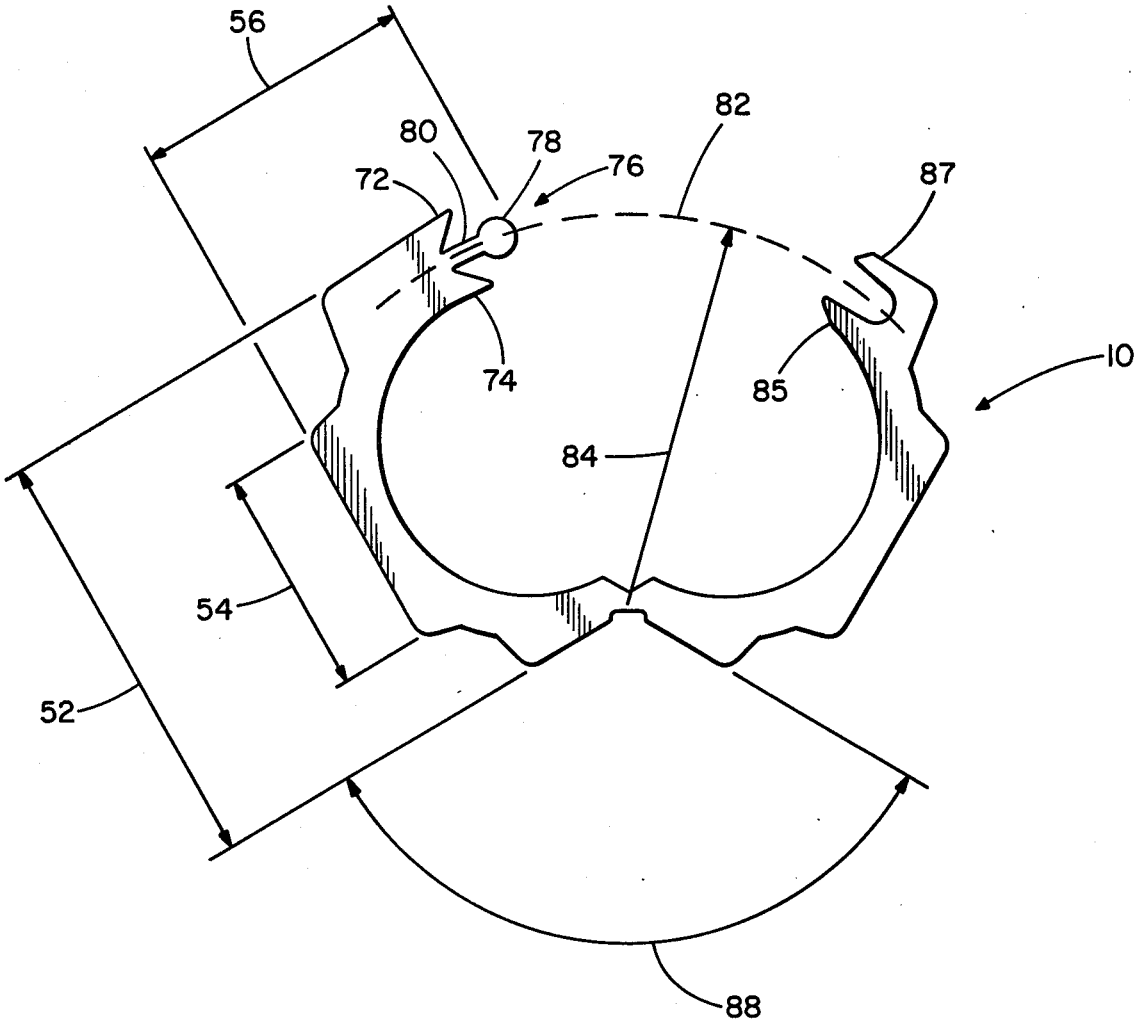
FIG. 7 is a cross sectional view of the connector illustrating the configuration of the locking mechanism prior to being closed and crimped about the cable.

The rib member 76 of the connector 10 comprises an enlarged portion 78 attached to a radially inwardly curved stem portion 80 (see FIG. 7). When the crimping force is applied to the four corner indentations (see FIGS. 5a–5c and FIGS. 6a–6c), the inner finger 85 bends radially outward about the enlarged portion 78 of the rib member 76 and toward the stem portion 80, while concurrently, the rib member 76 bends radially inward as the outer finger 87 bends radially inward about the enlarged portion 78 of the rib member 76 towards the stem portion 80. Thus the inner and outer fingers 85 and 87 and the rib member 76 are deformed to form a positive mechanical lock with the inner and outer ridges 74 and 72, which has a jig-saw puzzle like interface configuration. This positive mechanical lock resists opening when various torques and forces are applied to the connector by way of the cable under various field conditions.

As illustrated in FIG. 7, the connector 10 has a side 52 having a length of approximately 1.42 inches, the thickness of side 52 at its center being approximately 0.13 inches. Section 54 of side 52 has a length of approximately 0.84 inches. Section 56 has a length of approximately 0.95 inches. Ridges 72 and 74 have a height of approximately 0.11 inches and rib member 76 has a height of approximately 0.25 inches. The enlarged portion 78 of rib member 76 has a radius of approximately 0.06 inches and the curved stem portion 80 lies on imaginary curved line 82 having a radius 84 of about 1.29 inches. Fingers 85 and 87 have a length of approximately 0.24 inches. The connector's initially open position is defined by an angle 88 of approximately 120°.

Figure 9:
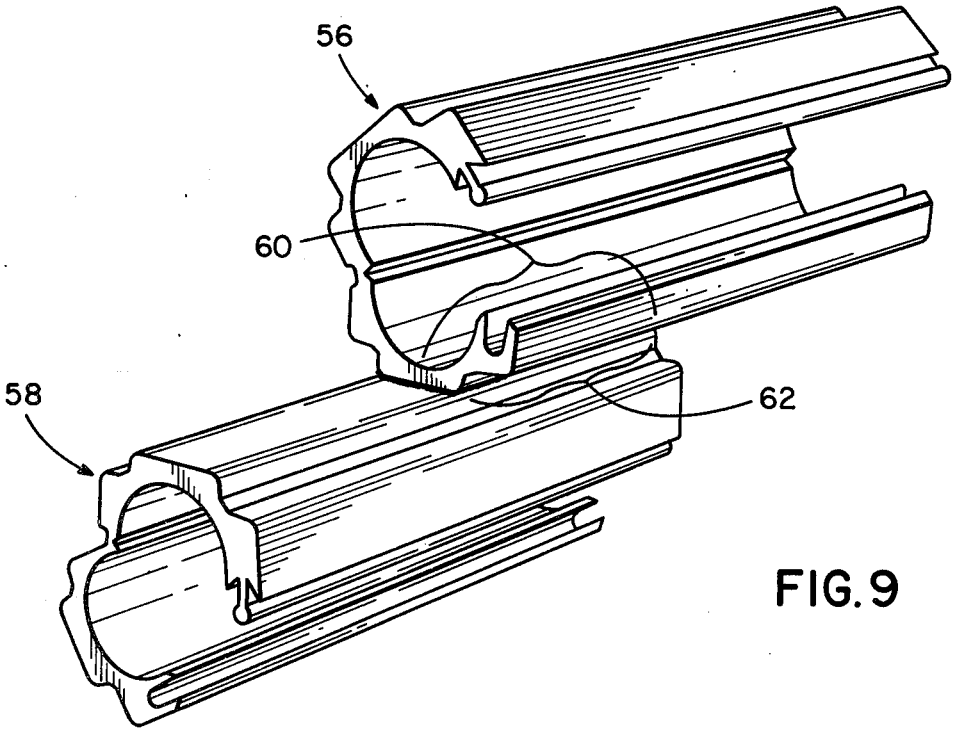
FIG. 9 is a perspective view of an alternative embodiment of the novel connector utilized in a parallel tap configuration.
Figure 8:
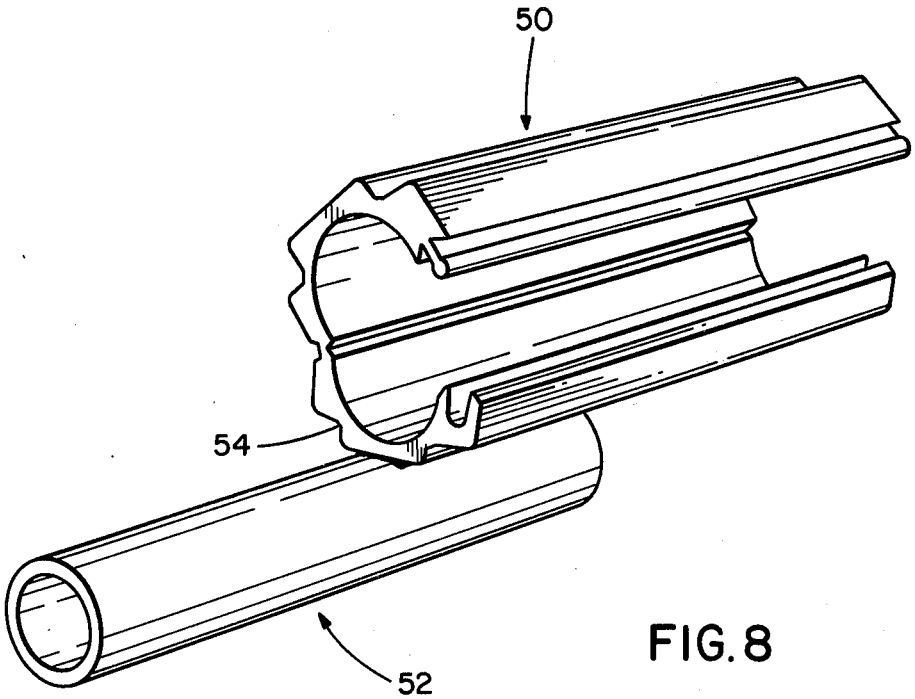
FIG. 8 is a perspective view of an alternative embodiment of the novel connector with a standard type connector in a parallel type configuration.
Figure 10:
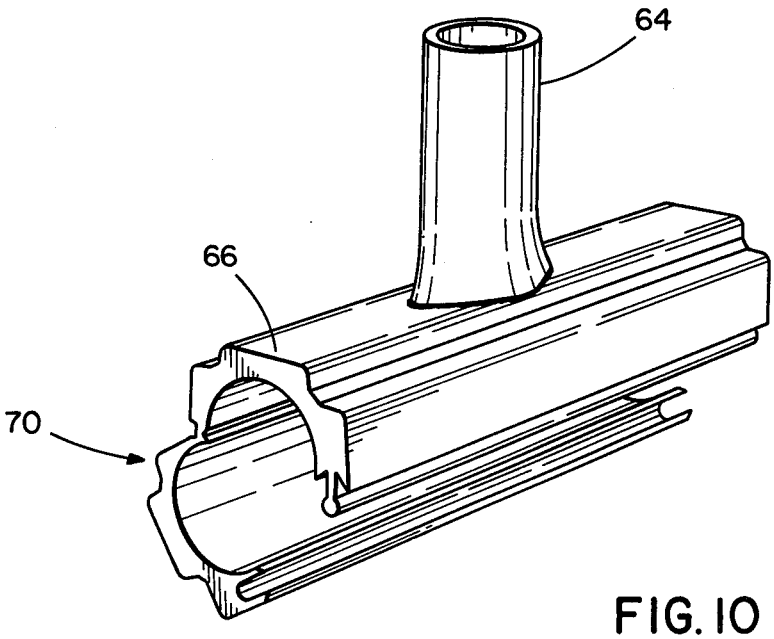
FIG. 10 is a perspective view of an alternative embodiment of the novel connector in combination with a standard connector in Tee-tap configuration.

FIGS. 8, 9 and 10 illustrate alternative embodiments of the present invention. FIG. 8 illustrates a parallel tap configuration utilizing the novel connector of the present invention. A standard ductile tubular shaped joining member 52 is attached (such as by welding) to the body member 54 of the connector 50. The joining member 52 receives the end of a second electrical cable for tapping off from a main cable which the connector 50 is attached to. The end of the second cable is secured within the joining member 52 by an external crimping force applied to the outer surface of the joining member 52.

FIG. 9 depicts a parallel tap configuration utilizing two of the novel connectors of the present invention. A first connector 56 is attached to a second connector 58 in an axially parallel side-by-side orientation and in a staggered arrangement such that only a first predetermined portion 60 of the first connector 56 overlaps a second predetermined portion 62 of the second connector 58.

FIG. 10 depicts a tee-tap configuration in which a joining member 64 is attached to the first leg 66 of a connector 70 in an axially perpendicular orientation.

The invention is not limited to the particular details of construction of the device depicted and other modifications and applications are contemplated. For example, the positive mechanical lock having a jig-saw puzzle like interface may be achieved using conventional crimping processes as well as using the VERSA-CRIMP process. Also the novel connectors may be manufactured in various diameters and various lengths. Certain other changes may be made in the above described device without departing from the true spirit and scope of the invention herein involved. It is intended therefore that the subject matter in the above depiction shall be interpreted as illustrative and not in a limiting sense.

What is claimed is:

1. A ductile metallic electrical and mechanical connector for attachment to one or more electrical cables and formable by a compressible process, said connector comprising:

at least one bifurcated body member having first and second leg portions initially connected by a reduced cross-sectional thickness portion of said body member to provide a plastically flowable hinge connection, said first and second leg portions defining an initial predetermined angle such that said body member can laterally engage an uninsulated section of an electrical cable;

said first leg having on the end opposite said reduced thickness portion an axially extending rib member and axially extending inner and outer ridges disposed on either side of said rib member;

said second leg having on the end opposite said reduced thickness portion axially extending inner and outer fingers, said rib member, said inner and outer ridges and said inner and outer fingers being oriented such that said outer finger lies between said outer ridge and said rib member, and said inner finger lies between said inner ridge and said rib member, when said body member is closed about an uninsulated section of an electrical cable, said enclosure occuring by pivoting of said leg members about said reduced thickness portion in response to hand applied external pressure; and wherein said inner and outer fingers and said rib member are deformed to form a positive mechanical lock when an external crimping force is applied radially to said body member.

2. The connector defined in claim 1 wherein said rib member comprises an enlarged portion and a radially inwardly curved stem portion, said stem portion connecting said enlarged portion to said end of said first leg, and also wherein, when said crimping force is applied to said body member, said inner finger bends radially outward about said enlarged portion of said rib member towards said stem portion, while, concurrently, said rib member bends radially inward and said second finger also bends radially inward about said enlarged portion of said rib member towards said stem portion to form a jig-saw puzzle-like interface configuration.

3. A ductile metallic electrical and mechanical connector for attachment to two or more electrical cables and formable by a compressible process, said connector comprising:

at least one bifurcated body member having first and second leg portions initially connected by a reduced cross-sectional thickness portion of said body member to provide a plastically flowable hinge connection, said first and second leg portions defining an initial predetermined angle such that said body member can laterally engage an uninsulated section of a first electrical cable;

said first leg having on the end opposite said reduced thickness portion an axially extending rib member and axially extending inner and outer ridges disposed on either side of said rib member;

said second leg having on the end opposite said reduced thickness portion axially extending inner and outer fingers, said rib member, said inner and outer ridges and said inner and outer fingers being oriented such that said outer finger lies between said outer ridge and said rib member, and said inner finger lies between said inner ridge and said rib member, when said body member is closed about an uninsulated section of an electrical cable, said enclosure occuring by pivoting of said leg members about said reduced thickness portion in response to hand applied external pressure;

a ductile tubular shaped joining member attached to said body member for receiving an end of a second electrical cable; and wherein said inner and outer fingers and said rib member on said body member are deformed to form a positive mechanical lock when an external crimping force is applied radially to said body member, and wherein said end of said second cable is secured within said joining member by an external crimping force applied to the outer surface of said joining member.

4. The connector defined in claim 3 wherein said joining member is attached to said body member in an axially parallel side-by-side orientation and in a staggered arrangement such that only a first predetermined portion of said joining member overlaps a second predetermined portion of said body member, thereby causing said connector when attached to said first and second electrical cables to form a parallel tap configuration.

5. The connector defined in claim 3 wherein a first end of said joining member is attached to said body member in an axially perpendicular orientation thereby causing said connector when attached to said first and second electrical cables to form a "tee"-tap configuration.

6. A ductile metallic electrical and mechanical connector for attachment to two electrical cables and formable by a compressible process, said connector comprising:

two bifurcated body members, each having first and second leg portions initially connected by a reduced cross-sectional thickness portion of said body member to provide a plastically flowable hinge connection, said first and second leg portions defining an initial predetermined angle such that said body member can laterally engage an uninsulated section of an electrical cable;

said first leg having on the end opposite said reduced thickness portion an axially extending rib member and axially extending inner and outer ridges disposed on either side of said rib member;

said second leg having on the end opposite said reduced thickness portion axially extending inner and outer fingers, said rib member, said inner and outer ridges and said inner and outer fingers being oriented such that said outer finger lies between said outer ridge and said rib member, and said inner finger lies between said inner ridge and said rib member, when said body member is closed about an uninsulated section of an electrical cable, said enclosure occurring by pivoting of said leg members about said reduced thickness portion in response to hand applied external pressure; and wherein said inner and outer fingers and said rib member on each of said body members are deformed to form a positive mechanical lock when an external crimping force is applied radially to each of said body members, and also wherein said two body members are attached in an axially parallel side-by-side orientation and in a staggered arrangement such that only a first predetermined portion of one body member overlaps a second predetermined portion of the other body member, thereby causing said connector when attached to the two electrical cables to form a parallel tap configuration.

7. A ductile metallic electrical and mechanical connector for attachment to one or more electrical cables and formable by a compressible process, said connector comprising:

a bifurcated body member having first and second leg portions initially connected by a reduced cross-sectional thickness portion of said body member to provide a plastically flowable hinge connection, said first and second leg portions defining an initial predetermined angle such that said body member can laterally engage an uninsulated section of an electrical cable, said body member being capable of being closed about the uninsulated section of the electrical cable by pivoting of said leg members about said redcued thickness portion in response to hand applied external pressure;

said body member, when in said closed position, having an inner surface of substantially circular cross-sectional configuration and an outer surface having four sides defining a substantially square cross-sectional configuration, said outer surface also being characterized by having four corner indentations, said reduced cross-sectional thickness portion being located at substantially the center of a first side of said four sides;

said first leg having on the end opposite said reduced thickness portion an axially extending rib member and axially extending inner and outer ridges disposed on either side of said rib member;

said second leg having on the end opposite said reduced thickness portion axially extending inner and outer fingers, said rib member, said inner and outer ridges and said inner and outer fingers being oriented such that said outer finger lies between said outer ridge and said rib member, and said inner finger lies between said inner ridge and said rib member, when said body member is in said closed position, and said rib member, said inner and outer ridges, and said inner and outer fingers being located away from the center of a second side of said four sides, and near one of said corner indentations adjacent said second side, said second side being opposite said first side; and wherein said inner and outer fingers and said rib member are deformed to form a positive mechanical lock with the inner and outer ridges when an external crimping force is applied radially to said body member.

8. The connector defined in claim 7 wherein said rib member comprises an enlarged portion and a radially inwardly curved stem portion, said stem portion connecting said enlarged portion to said end of said first leg, and also wherein, when said crimping force is applied to said four corner indentations, said inner finger bends radially outward about said enlarged portion of said rib member towards said stem portion, while, concurrently, said rib member bends radially inward and said outer finger also bends radially inward about said enlarged portion of said rib member towards said stem portion to form a jig-saw puzzle-like interface configuration.

* * * * *